United States Patent [19]

Ruscheweyh

[11] Patent Number: 4,498,786

[45] Date of Patent: Feb. 12, 1985

[54] APPARATUS FOR MIXING AT LEAST TWO INDIVIDUAL STREAMS HAVING DIFFERENT THERMODYNAMIC FUNCTIONS OF STATE

[75] Inventor: Hans Ruscheweyh, Aachen, Fed. Rep. of Germany

[73] Assignee: Balcke-Dürr Aktiengesellschaft, Ratingen, Fed. Rep. of Germany

[21] Appl. No.: 318,722

[22] Filed: Nov. 6, 1981

[30] Foreign Application Priority Data

Nov. 15, 1980 [DE] Fed. Rep. of Germany ..... 3043239

[51] Int. Cl.[3] ..... B01F 5/00

[52] U.S. Cl. ..... 366/336; 48/180 B; 137/896; 366/337

[58] Field of Search ..... 366/336, 337, 338; 137/896, 897, 898; 48/180 B, 180 C, 180 M, 180 R; 138/38, 42; 417/151

[56] References Cited

U.S. PATENT DOCUMENTS

| | | | |
|---|---|---|---|
| 1,088,711 | 3/1914 | Lindmueller | 48/180 M |
| 1,312,147 | 8/1919 | Wallwin | 48/180 M |
| 1,493,919 | 5/1924 | Cunningham | 48/180 M |
| 3,671,208 | 6/1972 | Medsker | 366/173 |
| 3,868,967 | 3/1975 | Harding | 366/338 |
| 4,026,527 | 5/1977 | Costen | 366/165 |
| 4,099,268 | 7/1978 | Luthi | 366/338 |

*Primary Examiner*—Robert W. Jenkins

*Attorney, Agent, or Firm*—Martin A. Farber

[57] ABSTRACT

The present invention relates to a method and devices for mixing at least two individual streams having different variables. In order to produce a low-loss, effective mixing within a short flow section, at least one eddy impulse is produced in the cross section of flow of at least one individual stream, which impulse spreads out downstream transverse to the direction of flow to form a discrete eddy system whose components transverse to the main direction of flow overlap into the other flow cross section of the other individual stream. This eddy impulse can be produced either by at least one curved surface or by at least one edge of a surface or of a body. The eddy impulse is preferably produced by two burble (flow break-away) edges of a delta-shaped insert element which extend at an acute angle to each other.

5 Claims, 30 Drawing Figures

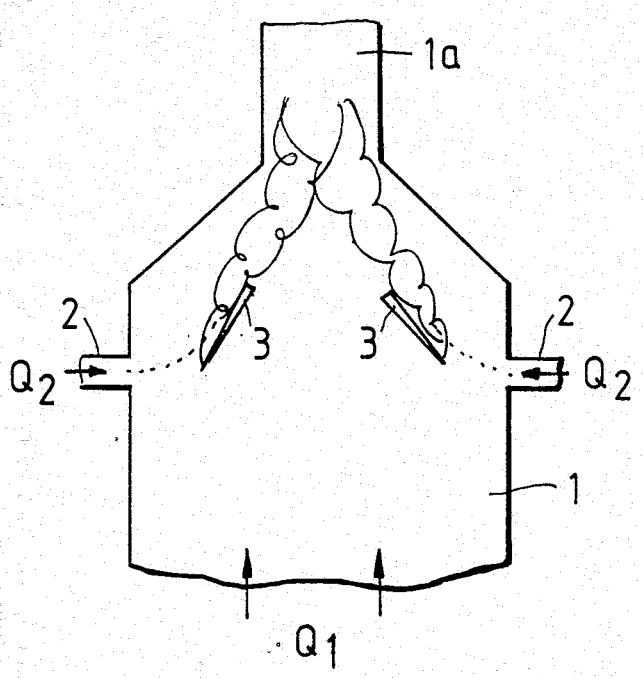
Fig.15
Fig.19
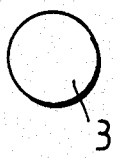
Fig.20
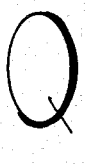
Fig.21
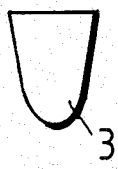
Fig.22
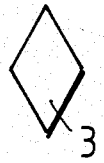
Fig.23
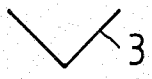
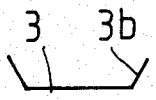
Fig.24
Fig.25
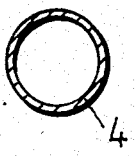
Fig.26
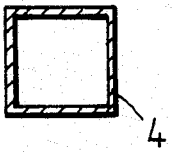
Fig.27
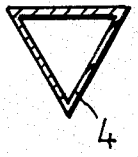
Fig.28
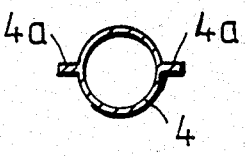

APPARATUS FOR MIXING AT LEAST TWO INDIVIDUAL STREAMS HAVING DIFFERENT THERMODYNAMIC FUNCTIONS OF STATE

For the mixing of several individual streams having different variables or values, use is made either of mechanically driven agitators when the flowing material is a liquid or of stationary guide surfaces which, particularly in the case of gaseous fluids, effect a deflection of the flow or parts of the flow so as to move the individual streams into one another and thereby mix them by deflecting the direction of flow.

The known methods and devices not only have the disadvantage of requiring a large structural expense but, due to their large degree of obstruction and the resultant deflection of the individual streams, produce a large pressure loss which, upon the operation of the system in question, may, have economically greater disadvantages due to the large consumption of energy inherent therein, and constitute a greater economic disadvantage than that represented by the structural expense.

The object of the present invention is to create a method and a device of the afore-mentioned type with which a low-loss, effective mixing of at least two individual streams having different variables is possible within a short flow length without a large structural expenditure or a high consumption of energy being necessary for this.

This object is achieved by the method of the invention and is characterized by producing, within the flow cross-section of at least one individual stream, at least one eddy impulse which spreads out downstream transverse to the direction of flow so as to form a discrete eddy system whose components transverse to the main direction of flow overlap or extend over the cross section of flow of the other individual stream. In accordance with other features of the invention, the eddy impulse can be produced by at least one curved surface and/or at least one edge of a surface or of a body. A preferred further development of the invention resides in producing the eddy impulse by two flow break-away edges of a delta-shaped insert element which extend at an acute angle to each other.

Practically complete mixing of the individual streams within a shorter flow path and with a considerably smaller pressure loss is obtained with the method of the invention. While a sufficiently uniform mixing of individual streams having different variable values requires in the known methods a mixing path whose length corresponds approximately to four times the diameter of the main conduit, the method of the present invention produces a considerably better mixing within only about half the mixing path and with a pressure loss which is only about 10 to 20% of the pressure loss of the known methods. These considerable advantages are obtained essentially in the manner that in the method of the invention no use is made of driven mixing devices or inserts of large guide surface and high degree of obstruction which positively deflect parts of the flows, but that, by means of fixed insert elements of low degree of obstruction, eddy impulses are produced which, by the spreading out thereof transverse to the direction of flow in, downstream direction, produce a low-loss mixing of the individual streams since the components of the eddy system which extend transverse to the main direction of flow overlap into or extend over the flow cross section of the other individual streams, and in this way produce an intensive mixing. The method of the invention can be used both for liquids and for gases and is particularly suitable for solving the most varied mixing tasks in the mixing of flue gases, exhaust gases and vapors.

The device for carrying out the method of the invention uses a separate feed conduit for each individual stream. If a main conduit in which other feed conduits discharge is used for the feeding of an individual stream, these feed conduits can be connected to the main conduit either in a common cross sectional plane, i.e. spatially together, or else individually, i.e. spatially apart. The cross section both of the feed conduits and of the main conduit may be round (circular or oval) or rectangular or of any other cross section. The ratio of the flow cross sections of the individual conduits to each other may also be selected at will so that the cross sections of the feed conduits in particular may be of different size. An insert element in accordance with the invention is arranged at least in the flow cross section of one individual stream.

The device in accordance with the invention for carrying out the method of the invention described above is featured, in order to produce the discrete eddy system, by the insert element having at least one flow break-away line which is directed transversely to the main direction of flow of the corresponding individual stream. In this way assurance is had that the insert element produces an eddy impulse which spreads out to form a discrete eddy system downstream, transverse to the direction of flow, the components of the eddy system which enter overlap into the flow cross-section of the other individual streams resulting in a low-loss, intensive mixing of the individual streams.

The device of the invention not only produces an intensive mixing over a short path and with low pressure losses but also requires only an extremely small structural expense, which provides the possibility of even subsequently installing the device of the invention into already existing conduits. Since the insert elements of the invention do not serve to deflect parts of the flow but to produce impulses, they have an extremely small degree of obstruction and are insensitive to dirt.

If the device comprises a continuous main conduit which is at the same time the feed conduit for an individual stream, and at least one laterally connected feed conduit, then, in accordance with the invention, at least one insert element is arranged in the flow cross section of at least one individual stream within the feed conduit and/or the main conduit. The insert element may be arranged within the main conduit in the region of the mouth opening of the feed conduit or conduits and extend into the flow cross section of all individual streams. As an alternative, at least one insert element can be arranged in the flow cross section of each individual stream, particularly when there are feed conduits connected laterally to the main conduit. Finally, it is possible to arrange within the main conduit downstream of the discharge openings of the feed conduits at least one insert element which assures the mixing of the individual streams by the eddy system which spreads out downstream.

If the device has feed conduits which discharge parallel to each other within a common main conduit then, in accordance with the invention, one insert element is arranged in each case in the boundary flow surface between the flow cross sections of adjacent individual steams. In this case the feed conduits can discharge alongside of each other within the main conduits or extend concentrically to each other, in which latter case several insert elements are arranged uniformly distributed in the boundary flow surface, which is closed in the shape of a ring. In order to shorten the mixing path, intensify it by mixing and prevent possibly undesired swirling, further insert elements having an opposite direction of action can, in accordance with a further feature of the invention, be arranged in the main conduit downstream of those insert elements which are arranged in the boundary flow surfaces.

In devices having a plurality of feed conduits discharging parallel to each other into a common main conduit, as in particular in the case of flue-gas feeds into a chimney, an insert element is installed, in accordance with the invention, in the mouth opening discharge region of each feed conduit. These insert elements, due to the creation of the eddy system of the invention, insure a reliable and intensive mixing of the streams of flue gas having different variables, in particular sulfur content, even in case of varying quantity ratios between the individual streams.

If a plurality of feed conduits are connected laterally to a narrowing main conduit, it is proposed by the invention to arrange an insert element in each case in the boundary flow surface of the individual streams, in which case the direction of the resultant eddy systems can be adapted to the nozzle effect of the constriction.

In devices having a plurality of feed conduits discharging laterally into a main conduit, the feed conduits can—in accordance with a further proposal of the invention— extend into the main conduit by means of short feed pipes and the curved surfaces of these short feed pipes be shaped so as to produce in each case a discrete eddy system. In this case, the insert elements are formed by the short feed pipes of the feed conduits so that instead of the possibility in accordance with the invention of producing the eddy impulse by the edge of a surface or of a body, in this case a curved surface is used to produce the eddy impulse. The length of the short feed pipe extending into the main conduit is preferably between 10 and 25% of the diameter of the main conduit, the individual streams emerging from the short feed pipe in their turn stimulating portions of the fluid flowing within the main conduit to form an eddy. The short feed pipes may have a round or polygonal cross section (triangular, square or polygonal) and be provided with sharp-edged ledges on their curved surface in order to increase the impulse momentum for the eddying.

If the eddy impulse is to be produced, in accordance with the method of the invention, by at least one edge of a surface, it is proposed by the invention to develop the insert element as a surface whose edge has a course with both a component extending in the main direction of flow and a component extending transverse thereto. The edge of the insert element preferably has a symmetrical course with a plane of symmetry extending in the direction of the main flow. The insert element can be developed, in accordance with the invention, with a circular, elliptical, oval, parabolic or rhombic base shape. A particularly good effect is obtained if the insert element—in accordance with another feature of the invention—is developed with a delta shape with a vertex pointing upstream in the direction opposite to the direction of the main flow. In order to increase the stability of the insert element it can be shaped other than planar in cross section, developed in V-shape and/or provided with an edge bent off at an angle.

With the above and other objects and advantages in view, the present invention will become more clearly understood in connection with the detailed description of preferred embodiments, when considered with the accompanying drawings, of which:

Figure 4:
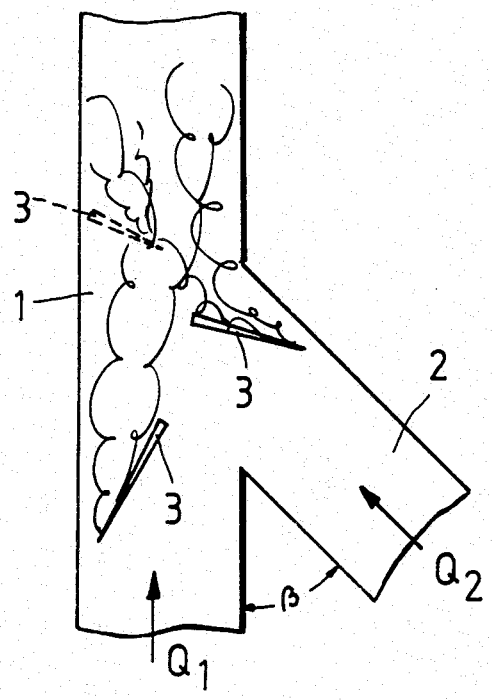
Figure 5:
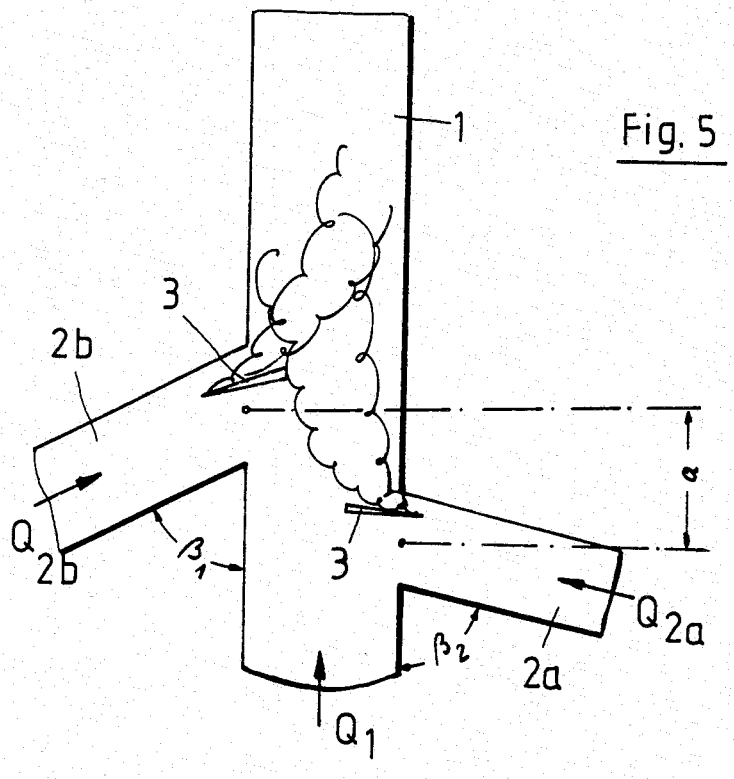
Figure 6:
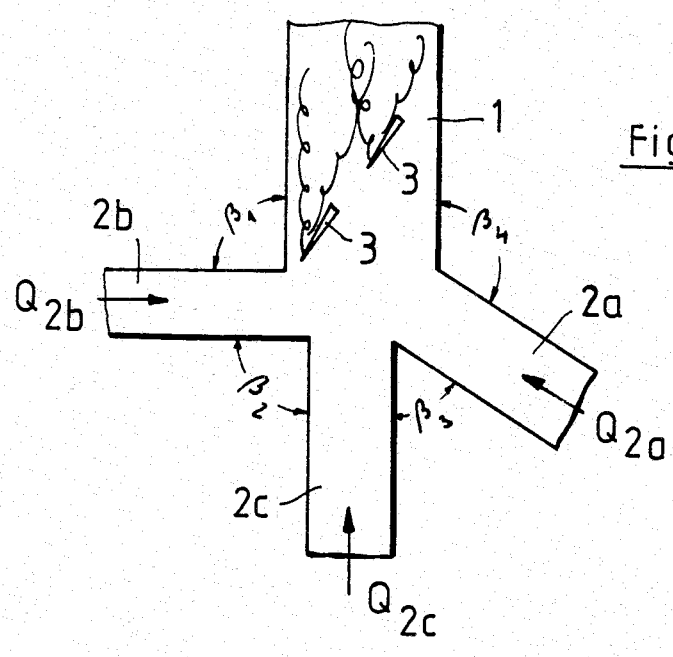
Figure 7:
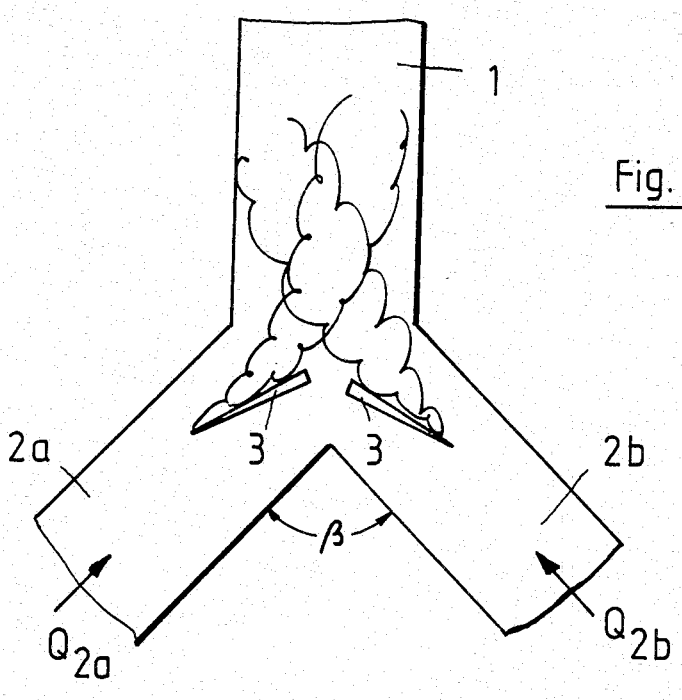
Figure 8:
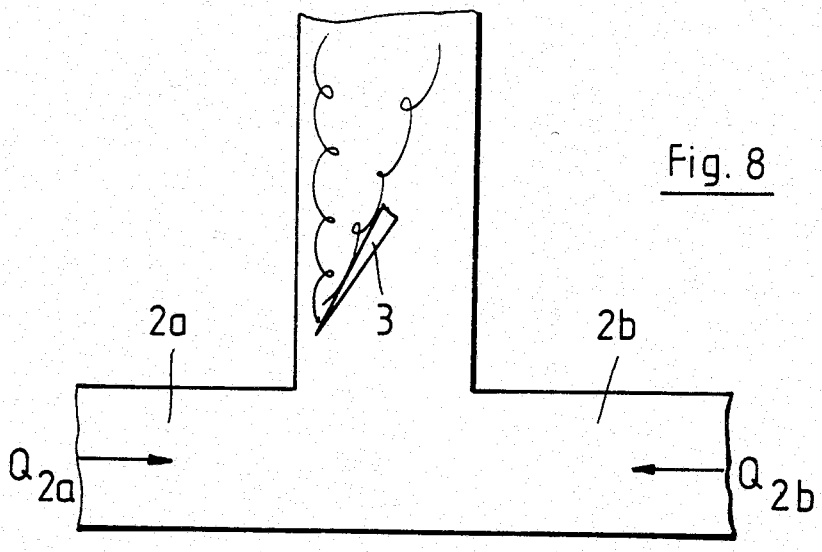
Figure 9:
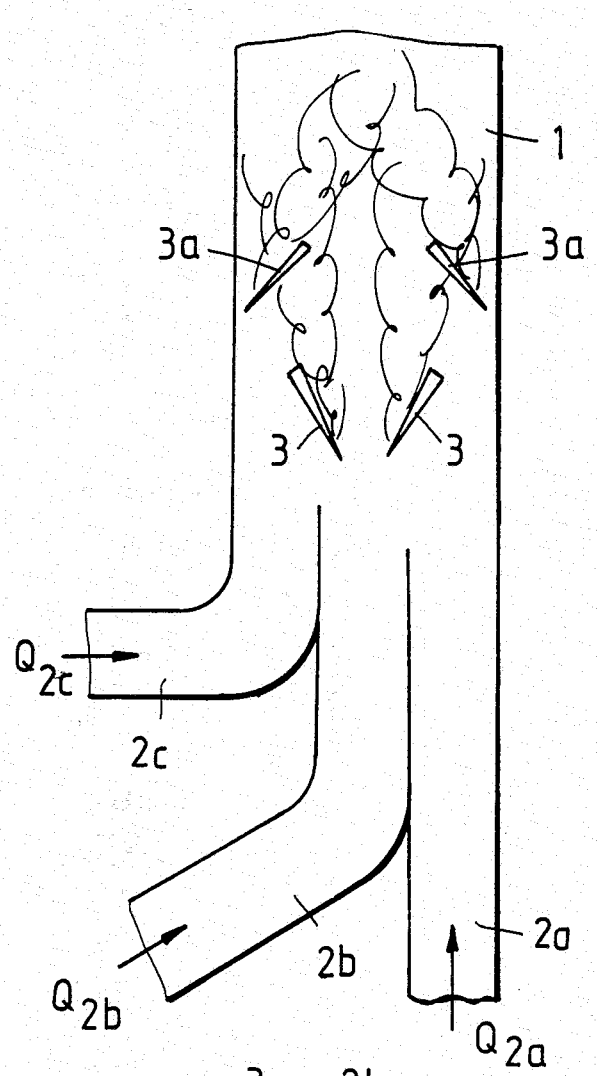
Figure 10:
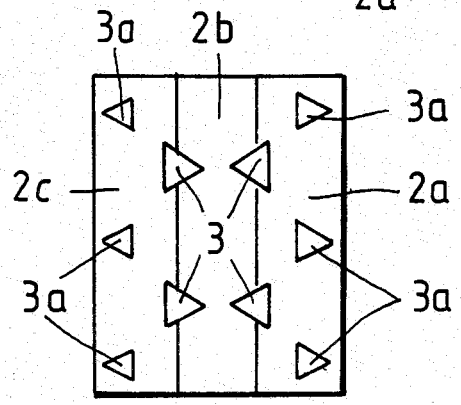
Figure 11:
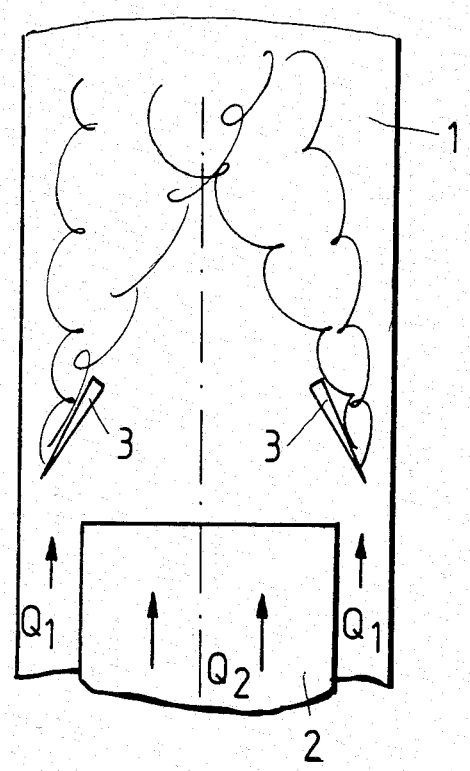
Figure 12:
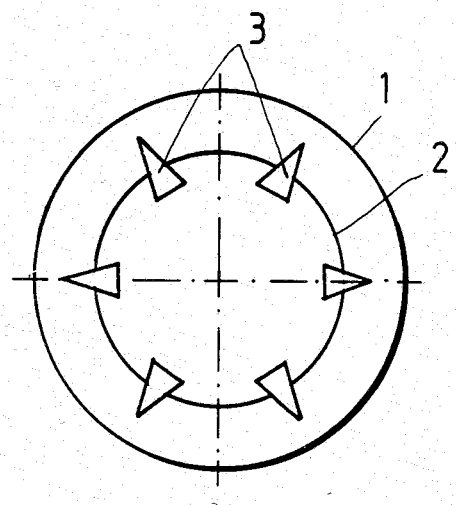
Figure 13:
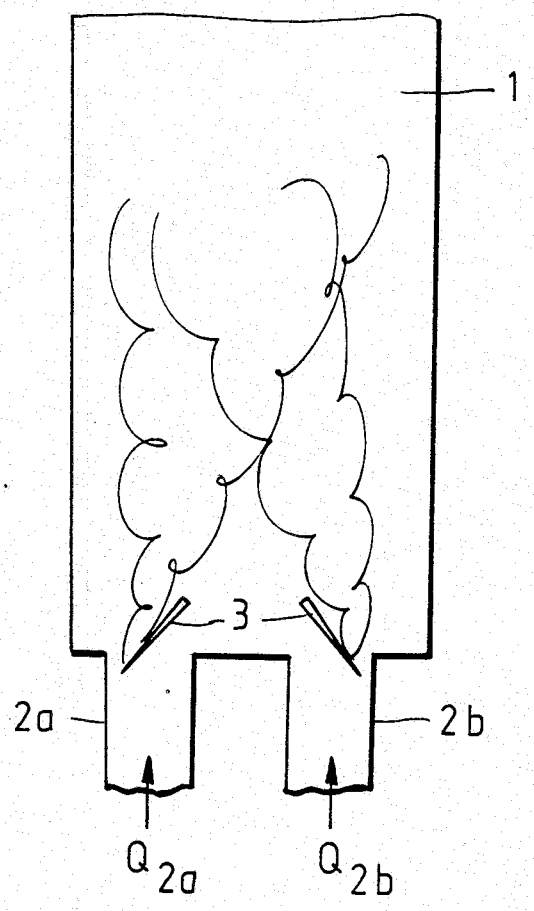
Figure 14:
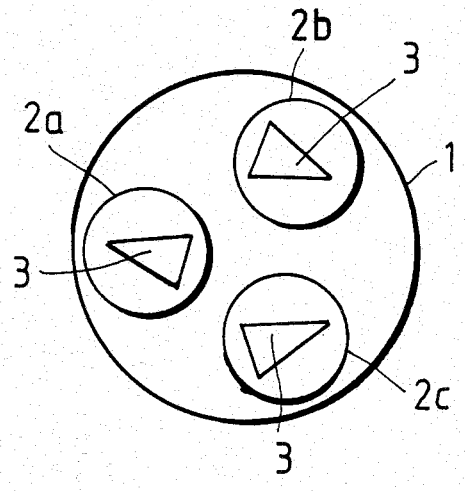
Figure 16:
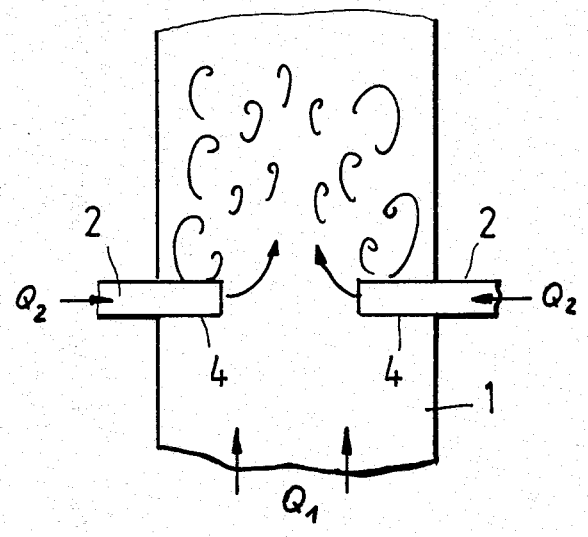
Figure 17:
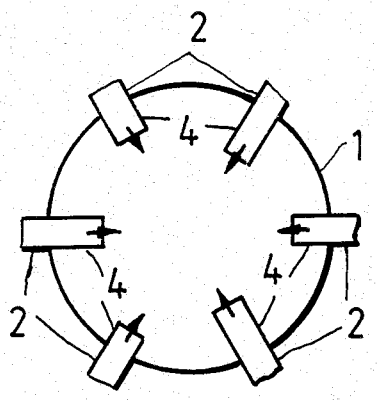
Figure 18:
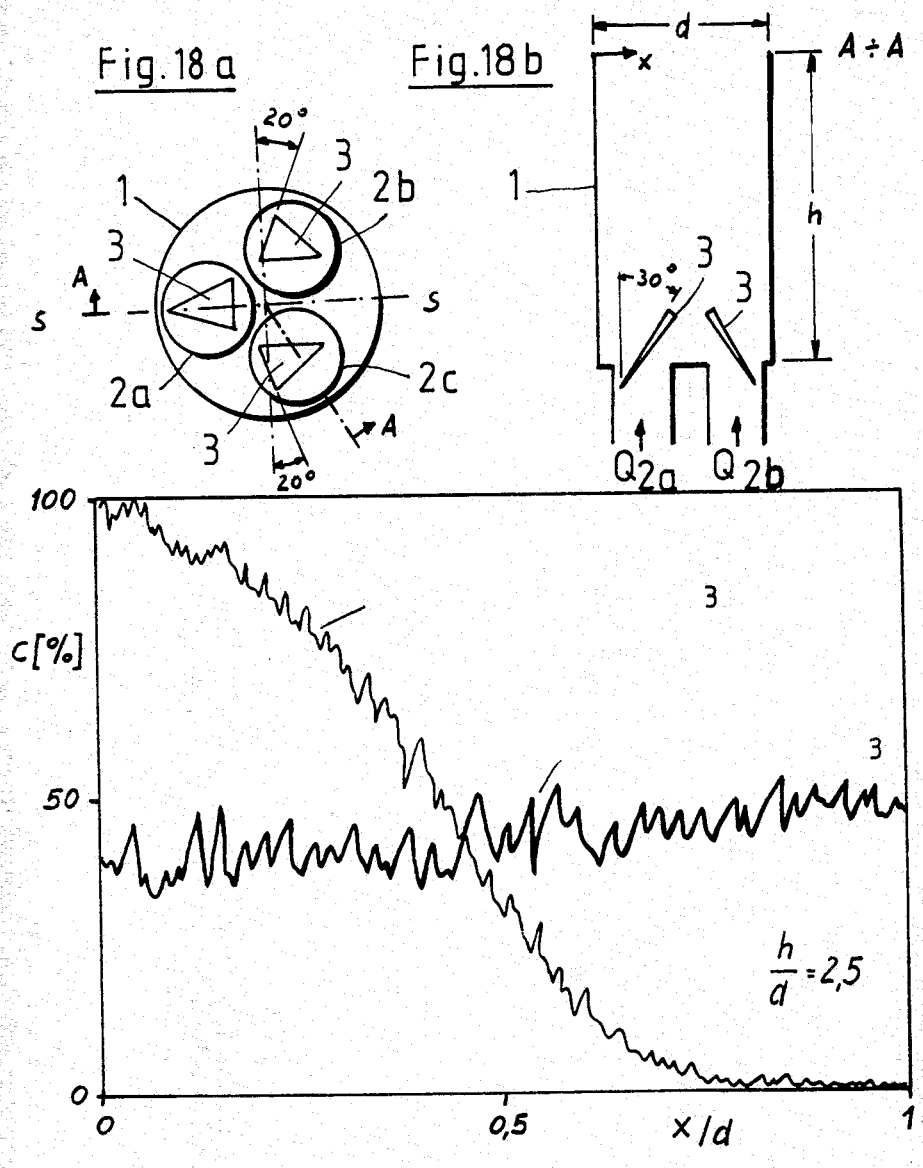

FIG. 4 a longitudinal section through a third embodiment, both of which have a continuous main conduit and a feed conduit which is connected at an acute angle on its side;

FIG. 5 is a longitudinal section through another embodiment in which two lateral feed conduits offset from each other are connected at acute angles to a continuous main conduit;

FIG. 6 is a longitudinal section through a main conduit to which three feed conduits are connected at different angles;

FIG. 7 is a longitudinal section through a main conduit is connected to two feed conduits which are brought symmetrically together at an acute angle;

FIG. 8 is another embodiment, shown in longitudinal section, in which two feed conduits which are directed towards each other discharge into a main conduit which is at a right angle to them;

FIG. 9 is a longitudinal section through a main conduit which, while having a constant constant flow cross-section, is formed by three rectangular feed conduits which discharge into it at different angles;

FIG. 10 is a top view of the main conduit shown in FIG. 9;

FIG. 11 is a longitudinal section through a main conduit which is formed without change in cross section by two feed conduits which pass concentrically into each other;

FIG. 12 is a top view of the main conduit of FIG. 11;

FIG. 13 is a longitudinal section through the lower part of a main conduit of circular cross section within which three feed conduits discharge which are also of circular cross section but of smaller cross sectional area;

FIG. 14 is a top view of the main conduit of FIG. 13;

FIG. 15 is a main conduit with narrowing cross section and a plurality of laterally connected feed conduits;

FIG. 16 is a main conduit of circular cross section to which six feed conduits of any desired cross section are connected, the latter extending with short feed pipes into the main conduit;

FIG. 17 is a top view of the main conduit of FIG. 16;

FIG. 18 is a graph of a model measurement of the smoke concentration, measured at the height h above the diagonal s—s of a model which is shown in top view in FIG. 18*a* and in longitudinal section in FIG. 18*b;*

FIGS. 19–22 are top views of four different basic shapes of an insert element;

FIGS. 23 and 24 are each a cross-section through an insert element; and

FIGS. 25 to 28 are cross-sections through four tubular insert elements.

Figure 1:
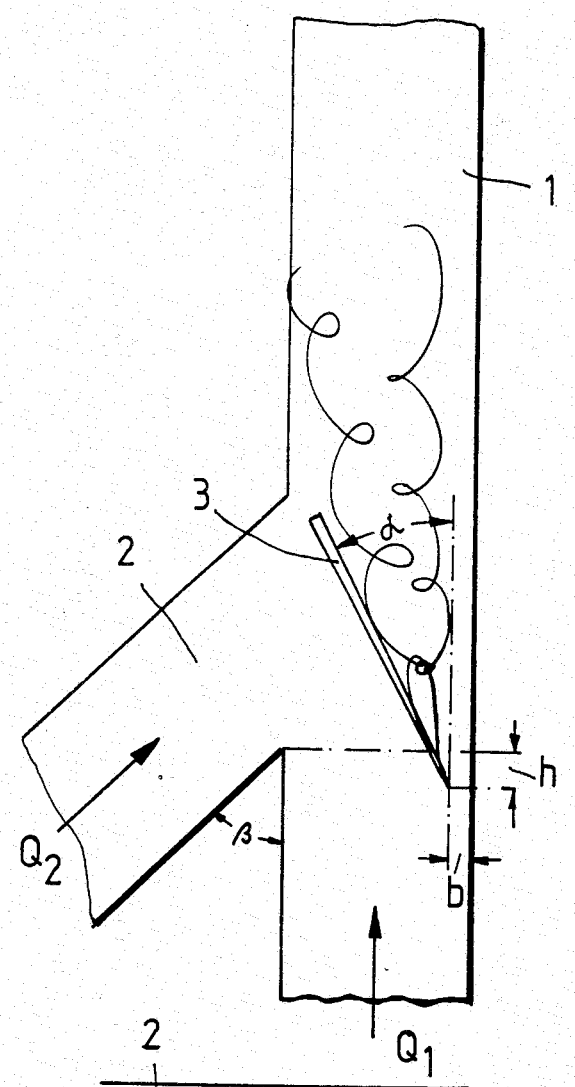
FIG. 1 is a longitudinal section through a first embodiment having a continuous main conduit and a feed conduit connected to it at an acute angle.
Figure 2:
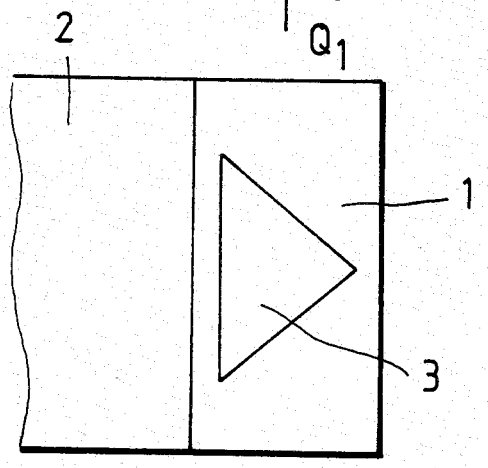
FIG. 2 is a top view of the device shown in FIG. 1.

The first embodiment, shown in FIGS. 1 and 2, shows a main conduit 1 of retangular cross section to which a feed conduit 2 is connected at an angle beta. The individual stream $Q_1$ flows within the main conduit 1 and an individual stream $Q_2$ is fed to it through the feed conduit 2.

In the region of the mouth of the feed conduit 2 there is arranged a delta-shaped insert element 3 which is arranged at an angle of action alpha with respect to the direction of flow of the individual stream $Q_1$ and has its vertex directed opposite or pointing counter to the direction of flow of the stream $Q_1$. This vertex of the insert element 3 is at a distance b from the continuous wall of the main conduit 1 and extends below the lower edge of the entering feed conduit 2 by the penetration depth h into the main conduit 1 upstream of the mouth opening position.

The edges which extend symmetrically to the direction of the main flow and have both a component extending in the direction of the main flow and also a component extending transverse thereto, produce eddy impulses which spread out downstream within the main conduit 1 transversely to the direction of flow to form a discrete eddy system, as indicated diagrammatically on FIG. 1. The components of this eddy system transversely to the main direction of flow of the individual stream $Q_1$ overlap into the cross section of flow of the individual stream $Q_2$ so that an intensive mixing of the individual streams $Q_1$ and $Q_2$ is obtained after they have been brought together. The delta-shaped insert element 3 does not, in this connection, effect any substantial deflection of the individual stream $Q_1$ but produces the mixing by means of the eddy system described above which prevents the two individual streams $Q_1$ and $Q_2$ from flowing alongside of each other in the upper part of the main conduit 1, as would be the case without the insert element 3. The upper edge of the insert element 3 extends up relatively far along the mouth of the feed conduit 2 so as to produce eddy impulses also in the feed conduit $Q_2$ and to prevent any remainder of the individual stream $Q_2$ from flowing upwardly unmixed along the wall of the main conduit 1. The figure shows that such a flow is prevented by the eddy system which spreads out downstream.

Figure 3:
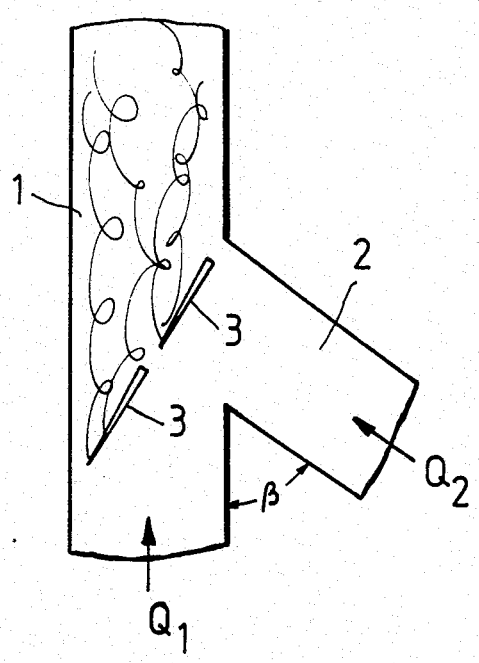
FIG. 3 is a longitudinal section through a second embodiment.

In the second embodiment, shown in FIG. 3, a lateral feed conduit 2 is again connected to a main conduit 1 at the connection angle beta. In the present case, however, two delta-shaped insert elements 3 are present in the main conduit 1, these insert elements assuring eddying in the main conduit 1 so that the individual stream $Q_2$ fed from the feed conduit 2 is intensively mixed with the individual stream $Q_1$ which comes from the lower part of the main conduit 1. The lower one of the two insert elements 3 produces in this case eddy impulses essentially within the individual steam $Q_1$ while the upper insert element 3 produces outwardly spreading eddy systems essentially in the individual stream $Q_2$.

Also in the case of the third embodiment, shown in FIG. 4, the feed conduit 2 is connected at an acute angle beta to the main conduit 1. An eddy system is again produced by an insert element 3 within the individual stream $Q_2$. Differing from the embodiment shown in FIG. 3, the eddy system in the individual stream $Q_2$ is formed by an insert element 3 which extends partly into the feed conduit 2 and is arranged in a direction opposite to the upper insert element 3 of FIG. 3. In this embodiment, a third additional insert element 3 can be arranged, in the main conduit 1, beyond the mouth of the feed conduit 2, as indicated in dashed line in FIG. 4. This additional insert element 3 produces a shortening of the mixing path by its additional eddy formation.

In the embodiment shown in FIG. 5, two feed conduits 2*a*, 2*b* are connected to a continuous main conduit 1 at angles $B_1$ and $B_2$ respectively, offset by the distance a in the longitudinal direction of the main conduit 1. In the mouth opening on discharge region of each feed conduit 2*a*, 2*b* there is arranged a delta-shaped insert element 3 which, in the manner indicated in FIG. 5, produces eddy systems which effect an intensive mixing of the individual streams $Q_{2a}$ and $Q_{2b}$ into the individual stream $Q_1$. The insert elements 3 extend in part into the corresponding feed conduits 2*a*, 2*b* so that the mixing path is shortened.

In accordance with the fifth embodiment, shown in FIG. 6, it may be sufficient in the case of a three-dimensionally common connection of three feed conduits 2*a*, 2*b*, 2*c* to a main conduit 1 to arrange downstream or behind the mouth opening discharge region a plurality of delta-shaped insert elements 3 which produce eddy systems extending over the entire cross section of the main conduit 1. In the embodiment shown in FIG. 6, the individual streams $Q_{2a}$, $Q_{2b}$ and $Q_{2c}$ are mixed in the main conduit 1, the feed conduits 2*a*, 2*b*, 2*c* being connected at different angles to the main conduit 1 and furthermore having different cross-sections of flow.

The further embodiment shown in FIG. 7 again has a main conduit 1 which is formed by two feed conduits 2*a* and 2*b* coming together symmetrically at an acute angle beta, through which feed conduits, the individual streams $Q_{2a}$ and $Q_{2b}$ respectively flow into the main conduit 1. In this embodiment, two delta-shaped insert elements 3 are arranged in the mouth opening discharge region of the feed conduits 2*a* and 2*b* which form intersecting eddy systems close downstream of the mouth opening discharge region and effect an intensive mixing of the individual streams $Q_{2a}$ and $Q_{2b}$.

The embodiment shown in FIG. 8 has two feed conduits 2*a* and 2*b*, directed opposite each other, for the individual streams $Q_{2a}$ and $Q_{2b}$ which enter into a main conduit 1 which branches off at a right angle. For the mixing of the individual streams $Q_{2a}$ and $Q_{2b}$ a delta-shaped insert element 3 is arranged in the main conduit 1, the edges of said element producing eddy systems causing to a low-loss mixing of the individual streams $Q_{2a}$ and $Q_{2b}$.

The embodiment of FIGS. 9 and 10 shows a main conduit 1 which is formed by three feed conduits 2*a*, 2*b* and 2*c* of rectangular cross-section which discharge parallel to and alongside of each other within the main conduit 1 but have been previously brought together from different directions. In this embodiment, several delta-shaped insert elements 3 are arranged in the boundary-flow surfaces between adjacent individual streams $Q_{2a}$ and $Q_{2b}$ and $Q_{2b}$ and $Q_{2c}$ respectively. These insert elements are the lower ones as seen in the longitudinal section and the four central ones as seen in the plan view of FIG. 10. In order to support the effect of these insert elements 3 and shorten the mixing path, further insert elements 3*a* are arranged in the main conduit 1 downstream of the insert elements 3 arranged in the boundary flow surfaces in the embodiment shown in FIGS. 9 and 10, said further insert elements being at an angle to the direction of flow opposite that of the lower insert elements 3 and feeding the individual streams $Q_{2a}$ and $Q_{2c}$ so as to achieve a faster mixing.

Instead of the feed conduits which discharge parallel and adjacent to each other within the main conduit 1 as shown in FIGS. 9 and 10, the feeding of an individual stream $Q_1$ to an individual stream $Q_2$ can also, in accordance with the embodiment shown in FIGS. 11 and 12, be effect with a concentric arrangement of the feed conduit 2 with respect to the main conduit 1. In this case also delta-shaped insert elements 3 are arranged in the boundary flow surface which is closed in the manner of a ring, the insert elements being uniformly distributed therein, as shown in the plan view of FIG. 12. The development of the eddy system is again indicated in FIG. 11, while the rotary symmetrical arrangement of the insert elements 3 can best be noted from FIG. 12.

The embodiment shown in FIGS. 13 and 14 has a main conduit 1 of circular cross section which is, for instance, the lower part of a chimney into which three feed conduits 2*a*, 2*b*, 2*c*, having circular flow cross sections of the same size, discharge parallel to each other from below. The flow cross section of the main conduit 1 is larger than the sum of the flow cross sections of the feed conduits 2*a*, 2*b*, 2*c*. In order to obtain an intensive mixing of the individual streams $Q_{2a}$, $Q_{2b}$ and $Q_{2c}$ in the main conduit 1, a delta-shaped insert element 3 is arranged in the mouth opening discharge region of each feed conduit 2*a*, 2*b*, 2*c*. The alignment of these insert elements 3 in the mouth openings of the feed conduits 2*a*, 2*b*, 2*c* is established in accordance with the individual volumes of the individual streams $Q_{2a}$, $Q_{2b}$ and $Q_{2c}$.

FIG. 18 shows in a graph the smoke concentration of a model measurement based on an embodiment in accordance with the example shown in FIGS. 13 and 14. FIGS. 18*a* and 18*b* show the different characteristic values for the model test in which the individual stream $Q_{2a}$ was identified with smoke while the individual streams $Q_{2b}$ and $Q_{2c}$ without smoke were passed through the feed conduits 2*b* and 2*c*. The smoke concentration was measured by means of a measurement probe along the diagonal s—s in FIG. 18*a*, this being done at the height h which corresponds to 2.5 times the diameter of the main conduit 1.

The approximately horizontal curve of the graph of FIG. 18 shows that despite the eccentric introduction of the smoke through the feed conduit 2*a* into the main conduit 1 complete mixing of the individual streams $Q_{2a}$, $Q_{2b}$ and $Q_{2c}$ is obtained as a result of the insert elements 3, the relatively strongly pronounced peaks and valleys of the approximately horizontal curve showing that eddies were formed locally in the measurement plane by the delta-shaped insert elements 3. The S-shaped curve which extends diagonally in the graph of FIG. 18 shows the condition without insert elements 3. It can be seen that in this case there is still a smoke concentration of practically 100% in the left part of the main conduit 1, at the height h which corresponds to 2.5 times the diameter of the main conduit 1. The resultant of low-loss, intensive mixing of the individual streams $Q_{2a}$, $Q_{2b}$ and $Q_{2c}$ which is obtained with the insert elements 3 can thus be demonstrated clearly on basis of the growth of FIG. 18.

In the embodiment shown in FIG. 15 the main conduit 1 is constricted to form an outlet conduit 1*a* at a place downstream of the place of connection of several feed conduits 2, each of which is of a considerably smaller cross section than the main conduit 1. In this case an insert element 3 is arranged in the region of each boundary flow surface shown in dashed line so that eddies are produced directed towards the constricted outlet conduit 1*a*.

While in the previous embodiments the insert elements were developed as delta-shaped surfaces with flow-break-away edges, the embodiment of FIGS. 16 to 17 shows the use of curved surfaces to produce the eddy impulses, which lead to a discrete eddy system which spreads out downstream transverse to the direction of flow. The figure shows a main conduit 1 of circular cross section to which a total of six feed conduits 2 are connected radially as well as perpendicularly. Each of the feed conduits 2 extends by means of a short feed pipe 4 into the main conduit 1. The curved surfaces of these short feed pipes 4 serve in each case to produce a discrete eddy system which spreads out downstream and ensures a good mixing of the individual streams $Q_2$ introduced through the feed conduit 2 with the individual streams $Q_1$, respectively. The short feed pipes 4 can be of circular, rectangular or triangular cross section, as shown in FIGS. 25 to 27. Short feed pipes 4 which are circular or oval in cross section are preferably provided, in accordance with FIG. 28, with two sharp-edged fins 4*a* on their outer surface, these fins serving as flow-break-away edges and increasing the impulse for the production of the eddy system.

Finally, FIGS. 19 to 22 show four different embodiments of the planar insert element 3. These figures show that instead of the delta-shaped development which has been explained previously, a circular, oval, parabolic or rhombic formation of the insert element 3 is also possible. As shown in FIG. 23, the insert element 3 can be developed with a V-shaped cross section in order to increase its stability. It is also possible to provide the insert element 3 with edges 3*b* which are bent off at an angle, as shown in FIG. 24, which on the one hand increase the stability and on the other hand assure sufficiently strong eddy impulses. The Figure references in the claims are for reference purposes as examples only but do not serve in any way as limitations.

While I have disclosed several embodiments of my invention, these embodiments are given by example only and not in a limiting sense.

I claim:

1. In a device for mixing at least two individual gas flow streams, the individual streams each defining a flow cross-section and a main direction of flow and discharging into each other via at least one discharge mouth, and at least one embodiment arranged in the flow cross section of a corresponding of the individual streams, the improvement wherein the element is a substantially, delta-shaped flat plate having planar surfaces and a sharp and free upstream V-shaped edge defining an upstream vertex and two portions of said edge on respective sides of said vertex, each of said two portions defining a sharp edge in cross-section, said surfaces of said plate being oriented inclined at a relatively small acute angle relative to said main direction of flow of the corresponding individual stream, said two portions of said edge extending transversely inclined to said main direction to flow of the corresponding individual stream, wherein said two portions of said edge producing therefrom within the flow cross section of said corresponding individual stream two continuous vortex momentums respectively initiating two conically widening oppositely rotating vortexes from each of said two portions of the edge, respectively, the vortexes travelling from the respective portions downstream and inclined relative to said main direction of flow while widening conically including transversely to the main direction of flow of said corresponding individual stream, extending into the flow cross section of at least one other of the individual streams, and effecting, substantially exclusively via said vortexes, mixing of said corresponding individual stream with said other of the individual streams.

2. The device according to claim 1 having a continuous main conduit constituting a feed conduit for said corresponding individual stream and having laterally connected thereto at least one feed conduit for at least said other of the individual streams, wherein said element is arranged in the flow cross section of at least said corresponding individual stream within at least one of said conduits.

3. The device according to claim 2, wherein said element is arranged in said main conduit in a vicinity of the discharge mouth of said at least one feed conduit and extends into the flow cross section of all said individual streams.

4. The device according to claim 1, wherein said at least one said element is arranged in the flow cross-section of each of said individual streams.

5. The device according to claim 1, wherein said element is formed continuously without openings.

* * * * *